US009062613B1

(12) United States Patent
Shen

(10) Patent No.: US 9,062,613 B1
(45) Date of Patent: Jun. 23, 2015

(54) VARIABLE STROKE AND COMPRESSION RATIO INTERNAL COMBUSTION ENGINE

(71) Applicant: Huixian Shen, West Bloomfield, MI (US)

(72) Inventor: Huixian Shen, West Bloomfield, MI (US)

(73) Assignee: Hi-Tech Forward, L.L.C., West Bloomfield, MI (US)

( * ) Notice: Subject to any disclaimer, the term of this patent is extended or adjusted under 35 U.S.C. 154(b) by 0 days.

(21) Appl. No.: 14/184,683

(22) Filed: Feb. 19, 2014

(51) Int. Cl.
*F02D 15/02* (2006.01)
*F02B 75/04* (2006.01)

(52) U.S. Cl.
CPC ..... *F02D 15/02* (2013.01); *F02B 75/048* (2013.01); *F02B 75/04* (2013.01)

(58) Field of Classification Search
CPC ..... F02B 75/04; F02B 75/045; F02B 75/047; F02B 75/048; F02B 75/32; F02D 15/00; F02D 15/02
USPC ..... 123/48 B, 78 F, 78 E, 197.3, 197.4
See application file for complete search history.

(56) References Cited

U.S. PATENT DOCUMENTS

| | | | | |
|---|---|---|---|---|
| 1,326,129 | A | 12/1919 | Chadbourne | |
| 1,912,604 | A * | 6/1933 | Valentine | 123/197.1 |
| 4,044,629 | A | 8/1977 | Clarke | |
| 4,917,066 | A * | 4/1990 | Freudenstein et al. | 123/48 B |
| 5,136,987 | A * | 8/1992 | Schechter et al. | 123/48 B |
| 5,927,236 | A | 7/1999 | Gonzalez | |
| 6,546,900 | B2 * | 4/2003 | Arai et al. | 123/48 B |
| 6,550,436 | B2 | 4/2003 | Nohara | |
| 6,575,128 | B2 | 6/2003 | Nakamura | |
| 6,595,186 | B2 | 7/2003 | Hiyoshi | |
| 6,647,935 | B2 | 11/2003 | Aoyama | |
| 6,938,589 | B2 * | 9/2005 | Park | 123/56.4 |
| 7,059,280 | B2 | 6/2006 | Nohara | |
| 7,174,865 | B2 * | 2/2007 | Sakita | 123/78 F |
| 7,234,424 | B2 | 6/2007 | Tanaka | |
| 7,455,041 | B2 * | 11/2008 | Meyer et al. | 123/197.4 |
| 7,578,266 | B2 * | 8/2009 | Venturi | 123/48 B |
| 7,681,538 | B2 * | 3/2010 | Hiyoshi et al. | 123/48 B |
| 7,827,943 | B2 * | 11/2010 | Cannata | 123/48 B |
| 8,261,703 | B2 | 9/2012 | Yoshikawa | |
| 8,539,917 | B2 * | 9/2013 | Lee | 123/48 B |
| 8,555,829 | B2 | 10/2013 | Lee et al. | |
| 2004/0154561 | A1 | 8/2004 | Lee | |
| 2005/0028762 | A1 | 2/2005 | Shiraishi et al. | |
| 2012/0291755 | A1 | 11/2012 | Perez | |

* cited by examiner

*Primary Examiner* — Lindsay Low
*Assistant Examiner* — Grant Moubry
(74) *Attorney, Agent, or Firm* — Young Basile Hanlon & MacFarlane P.C.

(57) ABSTRACT

A variable stroke and compression ratio internal combustion engine comprised of: a conventional crank shaft, a horizontal connecting rod, and a swinging block, which constitutes a typical swinging block slider crank mechanism; and a piston, a vertical connecting rod, and a pin mounted on the horizontal connecting rod, which constitutes a typical slider crank mechanism. The pivot of the swinging block is moveable based on a certain controlling strategy to realize variations of strokes and compression ratios.

14 Claims, 12 Drawing Sheets

VARIABLE STROKE AND COMPRESSION RATIO INTERNAL COMBUSTION ENGINE

CROSS-REFERENCE TO RELATED APPLICATIONS

Not Applicable

TECHNICAL FIELD

The present invention relates to internal combustion engines with variable strokes and variable compression ratios, in particular to the technology of realizing the stroke and compression ratio adjustment to improve engine performance.

BACKGROUND OF THE INVENTION

Internal combustion engines have been used for over 100 years and researchers are always pursuing to increase its thermal efficiency and decrease its emissions. One of the measures to achieve high efficiency and low emissions for ordinary spark ignition engines at partial load operating conditions is downsizing the engine displacement, so that the throttle has to be opened wider and the pumping loss will be minimized. However, the engine displacement is required to be large at high load conditions in order to provide enough power. These different requirements of an engine displacement at different engine operating conditions lead to various challenges in engine design.

One of the solutions to realize this variable displacement engine is selectively shutting off several cylinders of an engine at partial load conditions. This means that, instead of reducing the air-fuel mixture charge by partially closing the throttle at partial load conditions, the stroke volume of the engine is reduced by disabling some of the working cylinders. At high load conditions, more working cylinders are activated to achieve higher power. This cylinder deactivation at low load conditions is conducted by cutting-off the fuel supply to the specifically selected cylinders. This will result in non-stoichiometric air-fuel ratio of exhaust gases in the exhaust system. Therefore, a conventional three-way catalyst converter is not enough to meet after-treatment requirements, and some other equipment is needed such as an expensive lean NOx trapper and/or a selective catalyst reduction (SCR) device. Another approach of using smaller displacement engines at low load conditions is turbo-charging the gasoline engine. This kind of engine configuration can make the engine more efficient at low load conditions because the engine displacement is small and the throttle has to be opened wider than that required for larger displacement engines. Therefore, its pumping loss is lower. At high load conditions, a turbo-charging system is used to increase the engine intake pressure so that the engine can trap more air-fuel mixture, resulting in more power. The disadvantages of downsizing the engine in addition to using a turbo-charger are increased complexities of the engine structure and control system, and a higher cost.

Variable stroke is another approach to achieve the variable engine displacement requirement. One type of variable stroke concept is longer expansion and exhaust strokes and shorter intake and compression strokes referred to as the Atkinson cycle. This cycle can be achieved by a Miller cycle, which delays the time at which the intake valve closes to reduce the effective compression stroke so that the compression stroke is shorter than the expansion stroke. Chadboume U.S. Pat. No. 1,326,129 and Clarke U.S. Pat. No. 4,044,629 described an extended expansion stroke engine. Mazda made this kind of Miller cycle engines. Honda developed a multiple leakage system to accomplish their variable stroke engines and was granted a series of patents for their inventions. Nakamura, et al. U.S. Pat. No. 6,575,128, Hiyoshi et al. U.S. Pat. No. 6,595,186, Aoyama, et al. U.S. Pat. No. 6,647,935, Nohara et al. U.S. Pat. No. 7,059,280, Tanaka et al. U.S. Pat. No. 7,234,424, Nohara et al. U.S. Pat. No. 6,550,436 and Yoshikawa et al. U.S. Pat. No. 8,261,703 described those inventions. Luis Marino Gonzalez invented an internal combustion engine design wherein a variable stroke was accomplished by using a gear set arrangement to connect the crankshaft and the piston connecting rods of the engine via offset bearing surfaces, given by U.S. Pat. No. 5,927,236 and U.S. Pat. No. 2012/0291755. The goal of all of these variable stroke inventions is to achieve a variation in the length of a piston stroke over a complete engine power cycle. In particular, these inventions seek to increase the expansion stroke during the expansion portion of the power cycle to increase the torque output, and to reduce the stroke and piston velocity during the intake portions of the cycle to decrease the pumping loss.

In addition to the variable stroke mechanisms mentioned above that change the strokes within one engine cycle, other inventions, for example Carl D. Heflev U.S. Pat. Nos. 7,270,092 and 5,335,632 included a mechanism that can change the stroke at different operating conditions by using an offset crankshaft mechanism. Particularly, it can realize a small displacement at low load conditions and a large displacement at high load conditions.

The compression ratio of an internal combustion engine should be as high as possible provided that no knocks occur for gasoline engines and that the peak cylinder pressure is within limit for diesel engines. Therefore, it is necessary that the compression ratio be adjustable based on load and speed conditions in order to improve efficiency within the entire engine operating condition range. In addition, if an engine uses different types of fuels, the compression ratio should also be adjusted based on the fuel type. In general, high-octane fuel allows engines to work at higher compression ratios in order to achieve better thermal efficiency.

In summary, the optimal engine displacement and compression ratio of an internal combustion engine both vary depending on the engine operating condition and the type of fuel used.

SUMMARY OF THE INVENTION

In view of such engine performance requirements and the problems of previous inventions, the first objective of the present invention is to provide a variable stroke engine that has a high thermal efficiency and low emissions. The variations of the stroke will follow the engine power requirements. That is, the engine stroke will be longer to ensure large engine displacements at high load and speed conditions, and be shorter to increase thermal efficiency at low load and speed conditions.

The second objective of this invention is to provide a method to adjust the compression ratio of the engine. The compression ratio requirements are based on engine operating conditions and fuel types. This compression ratio adjustment can ensure the engine operates at the maximum thermal efficiency condition.

The third objective of this invention is to provide a strategy of controlling its engine stroke and compression ratio. For gasoline engines, when the engine operating condition changes, the control system will adjust both the stroke and the compression ratio to their optimized values. At a range of high load and speed conditions, the throttle usually keeps the position of the opening wide or near wide, and the compression ratio also stays at almost a constant. The stroke is adjusted to meet the engine load and speed requirements. At low load and speed conditions, the stroke stays at its minimum value and the throttle is adjusted to meet the load and speed requirements. Meanwhile, the compression ratio is adjusted to produce a high engine thermal efficiency.

These objectives can be achieved by this invention of a variable stroke and compression ratio internal combustion engine that is comprised of: at least one piston reciprocating in a cylinder; a crankshaft rotating and supported by a main engine body; one horizontal connecting rod per cylinder with one end capable of rotating and jointed to the crankshaft pin, and the other end jointed on a swinging block; a vertical connecting rod with one end jointed to the piston by the piston pin and the other end, commonly known as the big end, jointed to the horizontal connecting rod by a pin located in a position between the two ends of this horizontal connecting rod; a device mounted on the main engine body used to move the swinging block in the horizontal and vertical directions to achieve variable strokes and compression ratios.

The device used to move the position of the swinging block pivot that is jointed on the horizontal connecting rod can be either hydraulically controlled or electrically controlled. It can move the swinging block in the horizontal and/or vertical directions either separately or following a specified moving pattern. This device can also control and move the swinging block of one cylinder individually cylinder by cylinder, or control and move all of the swing blocks of all cylinders together for multiple cylinder engine applications.

The stroke of the present engine invention depends on the crankshaft radius, the position of the big end of the vertical connecting rod, and the position of the pivot of the swinging block that is attached to the horizontal connecting rod. The pivot of the swinging block moving towards the crankshaft will decrease the stroke, whereas it moving in the opposite direction will increase the stroke. The range of the stroke variation depends on the maximum distance to which the pivot can move. A large pivot moving distance results in a large stroke variation. However, it also increases the engine size. Therefore, the range of stroke variation is limited by the engine size.

The swinging block pivot moves vertically to adjust the compression ratio. The compression ratio requirement is not only related to the engine operating conditions and the types of fuel, but it is also related to the stroke value and the throttle opening position. A detailed study is required to determine the target compression ratio while taking into account all of these conditions. In principle, a higher compression ratio can be applied at lower load and higher throttle closing conditions in order to achieve high thermal efficiency and, at the same time, avoid knock occurrences.

Hereinafter, embodiments of the present invention will be described with reference to examples of the present invention that are shown in the accompanying drawings.

DETAILED DESCRIPTION OF THE PREFERRED EMBODIMENTS

The present invention is described in the following in more detail in terms of concrete embodiments with reference to the appended drawings.

Figure 1:
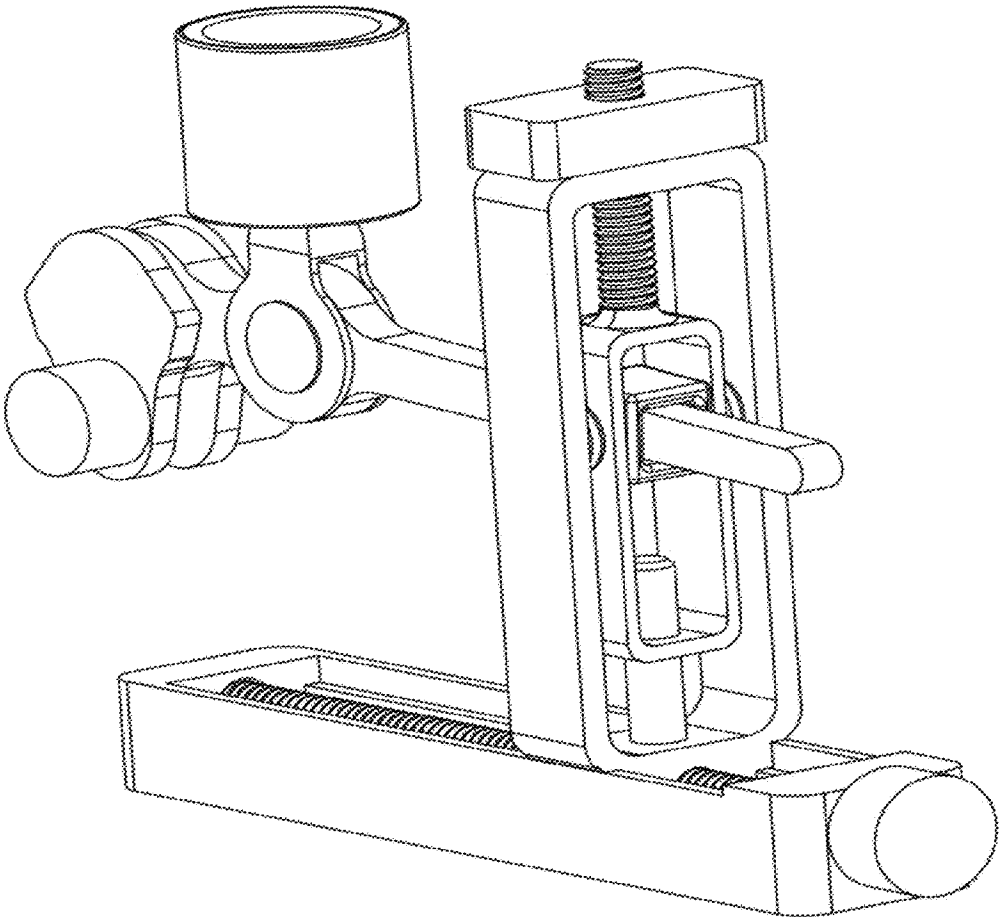
FIG. 1 is a three-dimensional schematic of a variable stroke and compression ratio engine given as an embodiment of the present invention.

FIG. 1 shows a three-dimensional schematic of the variable stroke and compression ratio engine given as an embodiment of the present invention.

Figure 2:
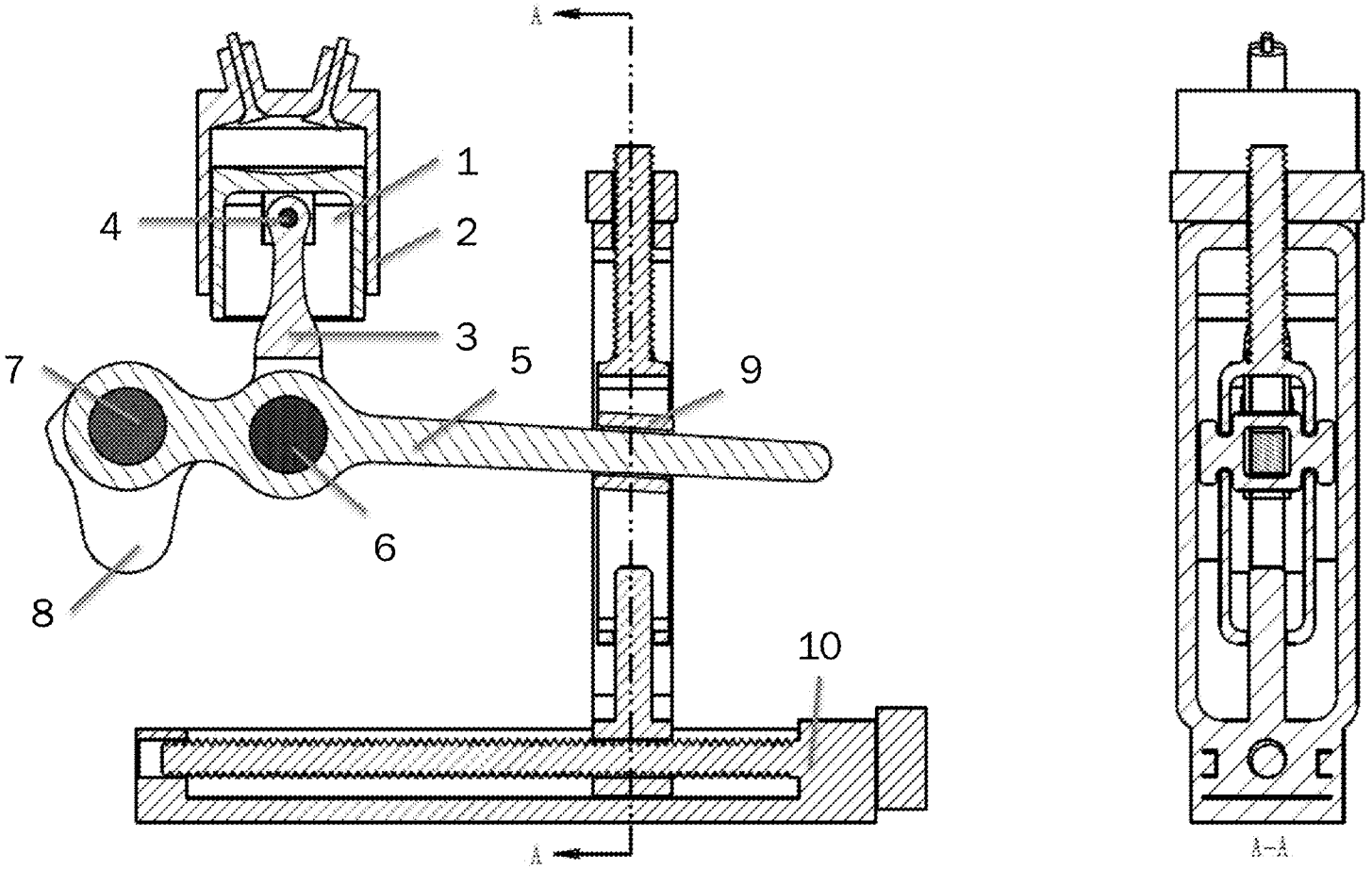
FIG. 2 is a simplified drawing section view of a variable stroke and compression ratio engine according to the embodiment of FIG. 1.

FIG. 2 is a simplified drawing section view of the same engine as an embodiment of the present invention. A piston 1 being able to reciprocate in a cylinder 2 is connected to a vertical connecting rod 3 by a piston pin 4. The other end of the vertical connecting rod 3 is jointed to a horizontal connecting rod 5 by a pin 6 mounted between the two ends of the horizontal connecting rod. The horizontal connecting rod 5 is connected to the crank pin 7 of a conventional crankshaft 8 at one end and joints to a swinging block 9 at the other end. The swinging block 9 is controlled to move in both horizontal and vertical directions by a device 10 similar to a translation stage and is mounted on the engine body (not shown in FIG. 2). Either linear stepper motors or hydraulic devices are used to drive this translation stage to move the swinging block in both horizontal and vertical directions. The other parts of the present engine invention, such as valves and their actuating mechanisms, intake and exhaust systems, etc. are not described since they may be similar to those of conventional engines.

Figure 3:
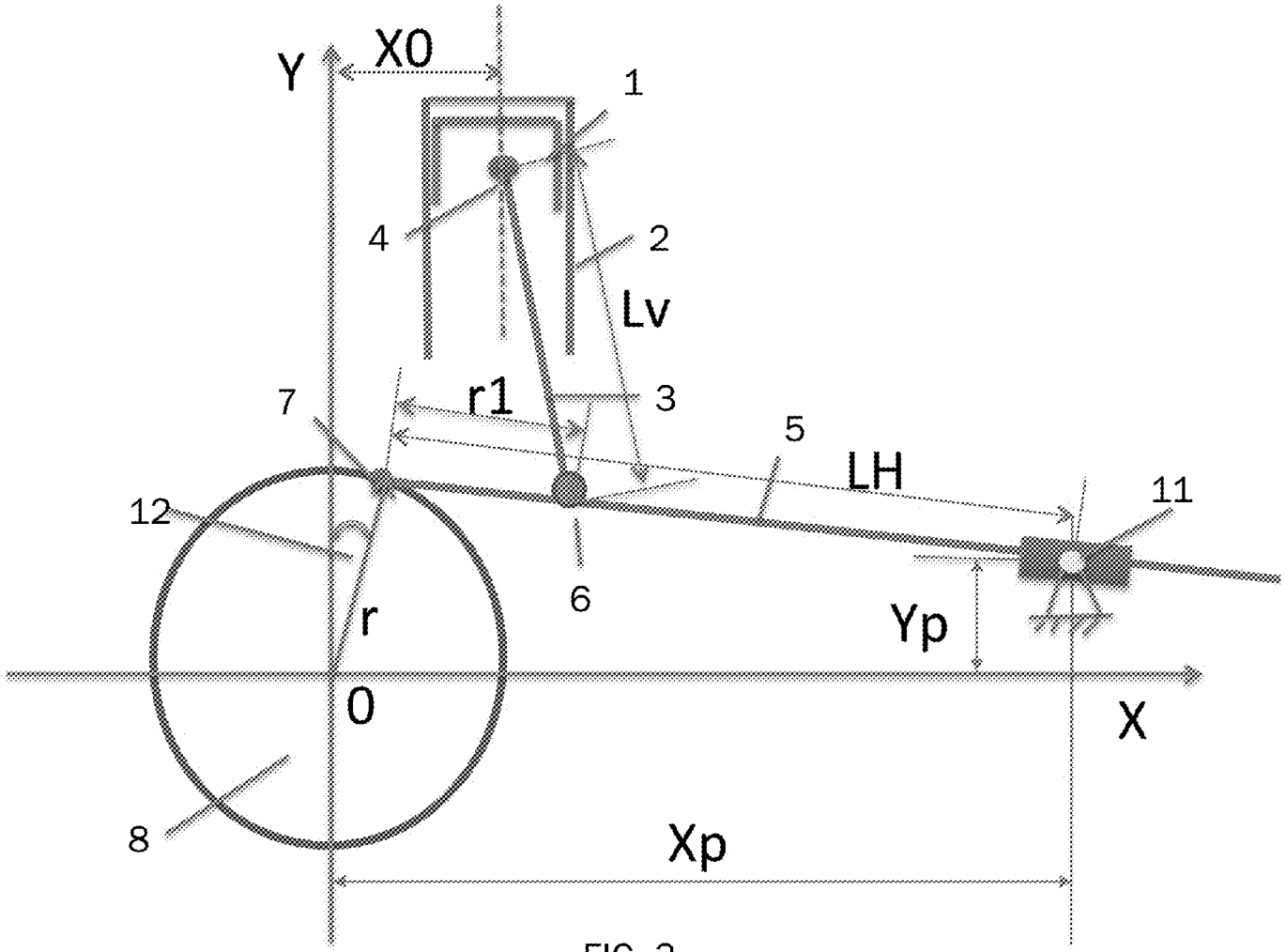
FIG. 3 is a simple illustration of the mechanism of the variable stroke and compression ratio engine according to the embodiment of FIG. 1.

FIG. 3 illustrates the mechanism of the variable stroke and compression ratio engine as an embodiment of the present invention. A crankshaft 8 with crank radius r, a horizontal connecting rod 5, and a swinging block 9 constitute a typical swinging block slider crank mechanism. A piston 1, a vertical connecting rod 3, and the big end of a connecting rod 3 attached with a pin 6 mounted on a horizontal connecting rod 5 constitute a typical slider crank mechanism, except that the pin 6 is not a crank pin. Therefore, the trajectory of the pin 6 is not the perfect circular path as taken by the crank pin 7. Instead, it is a function of the crank angle 12, the crank radius r, the distance between the crank pin 7 and the pin 6, r1, and the position of the swinging block pivot 11. By adjusting the x- and y-coordinates of the position of the swinging block pivot 11, the engine stroke and the compression ratio can be adjusted. When the x-coordinate, $x_p$, of the swinging block pivot 11 is closer to the crank pin 7, the engine stroke becomes shorter, and vice versa. Increasing the y-coordinate, $y_p$, of the swinging block pivot 11 will lead to a higher engine compression ratio, and vice versa.

Figure 4:
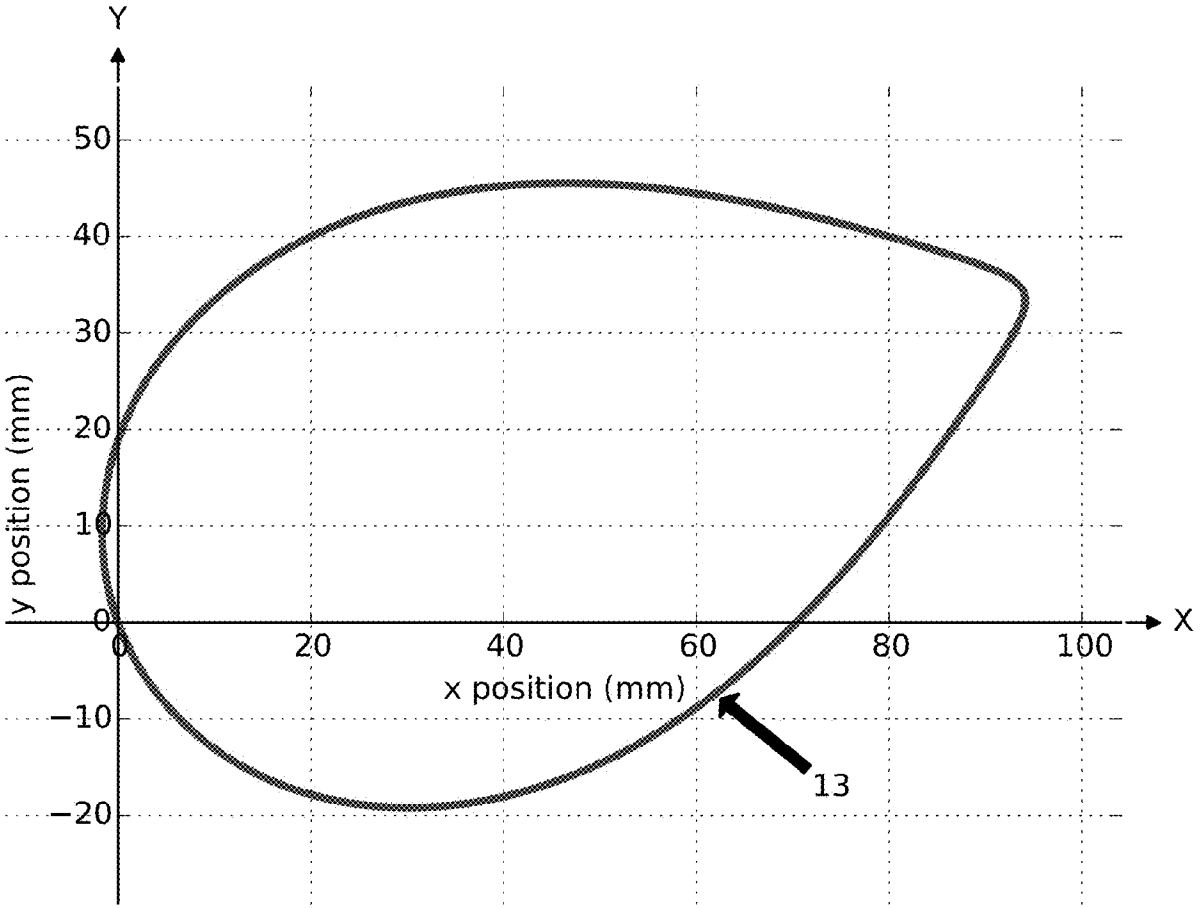
FIG. 4 is the trajectory curve of pin 6 for an example configuration of the present engine invention with the minimum stroke layout according to the embodiment of the present invention.
Figure 5:
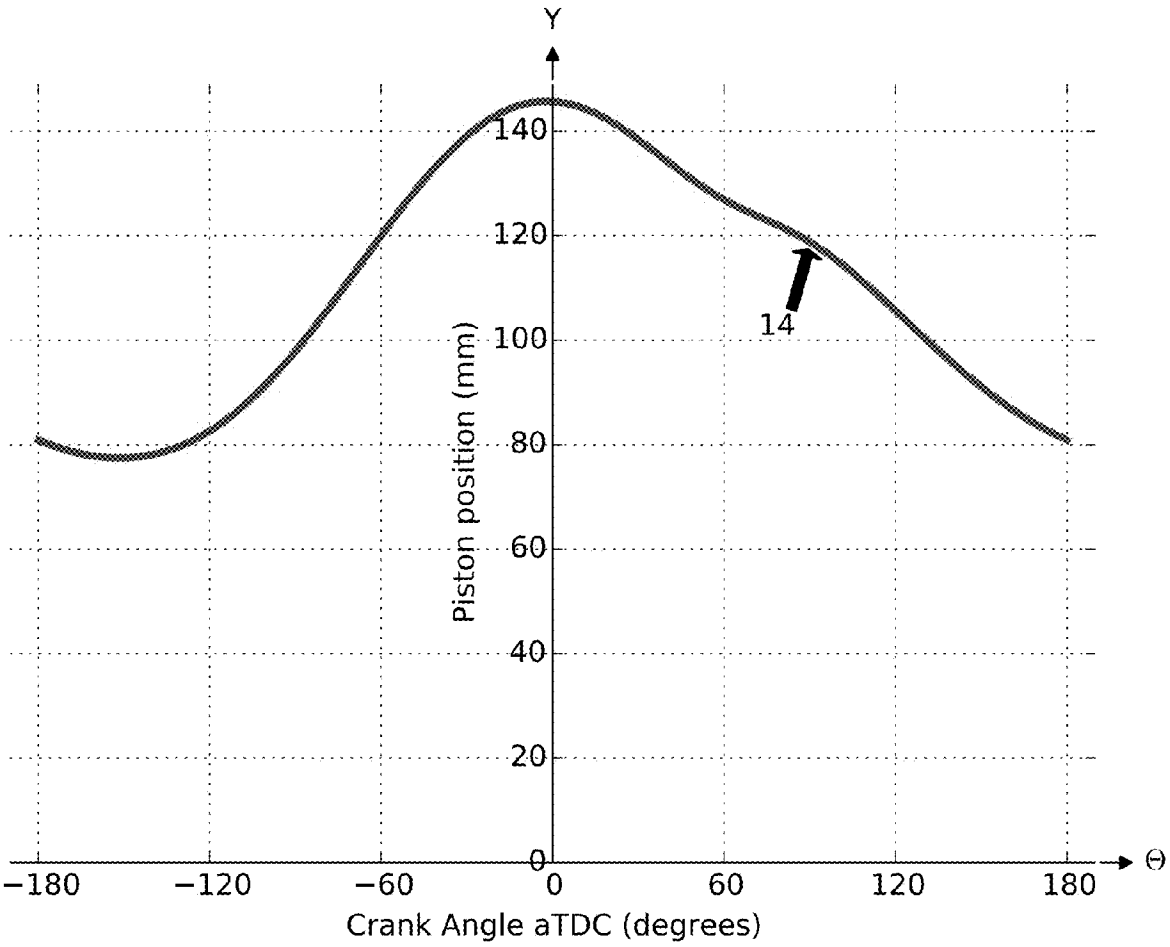
FIG. 5 is a curve depicting the piston movement position versus the crank angle for the same engine configuration as FIG. 4.
Figure 6:
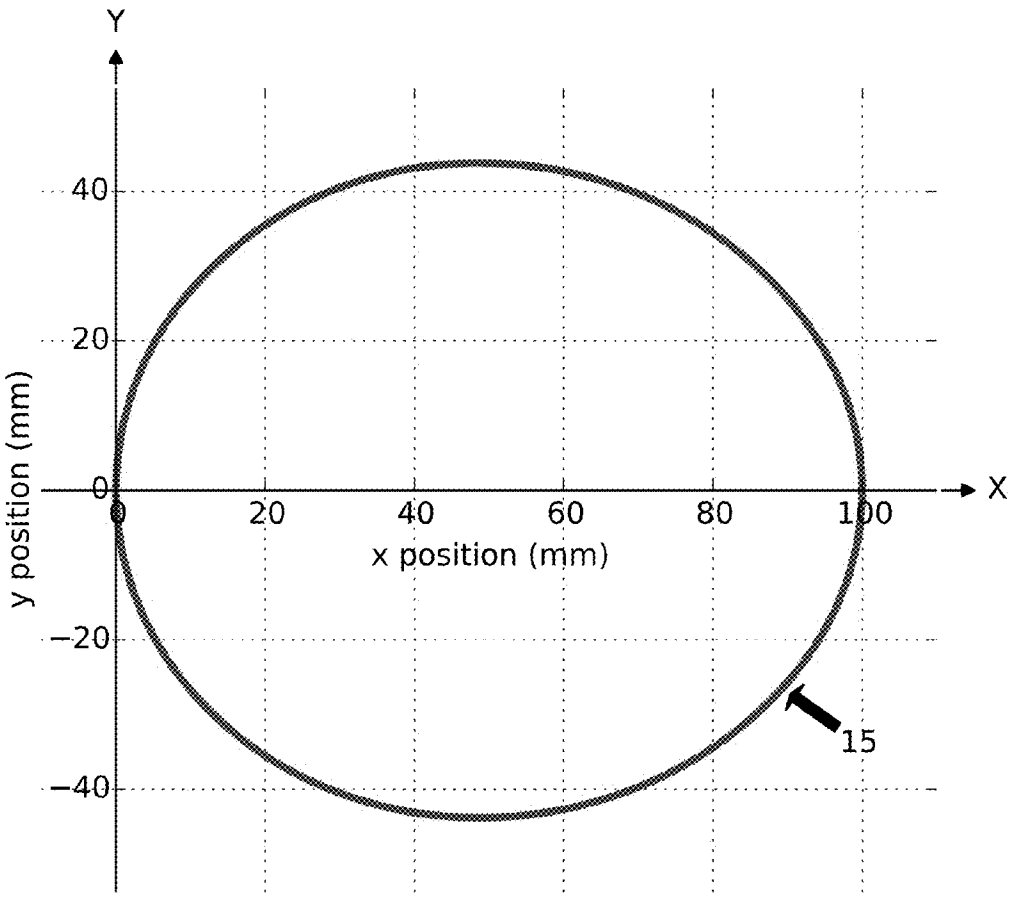
FIG. 6 is the trajectory curve of pin 6 for an example configuration of the present engine invention with the maximum stroke layout according to the embodiment of the present invention.
Figure 7:
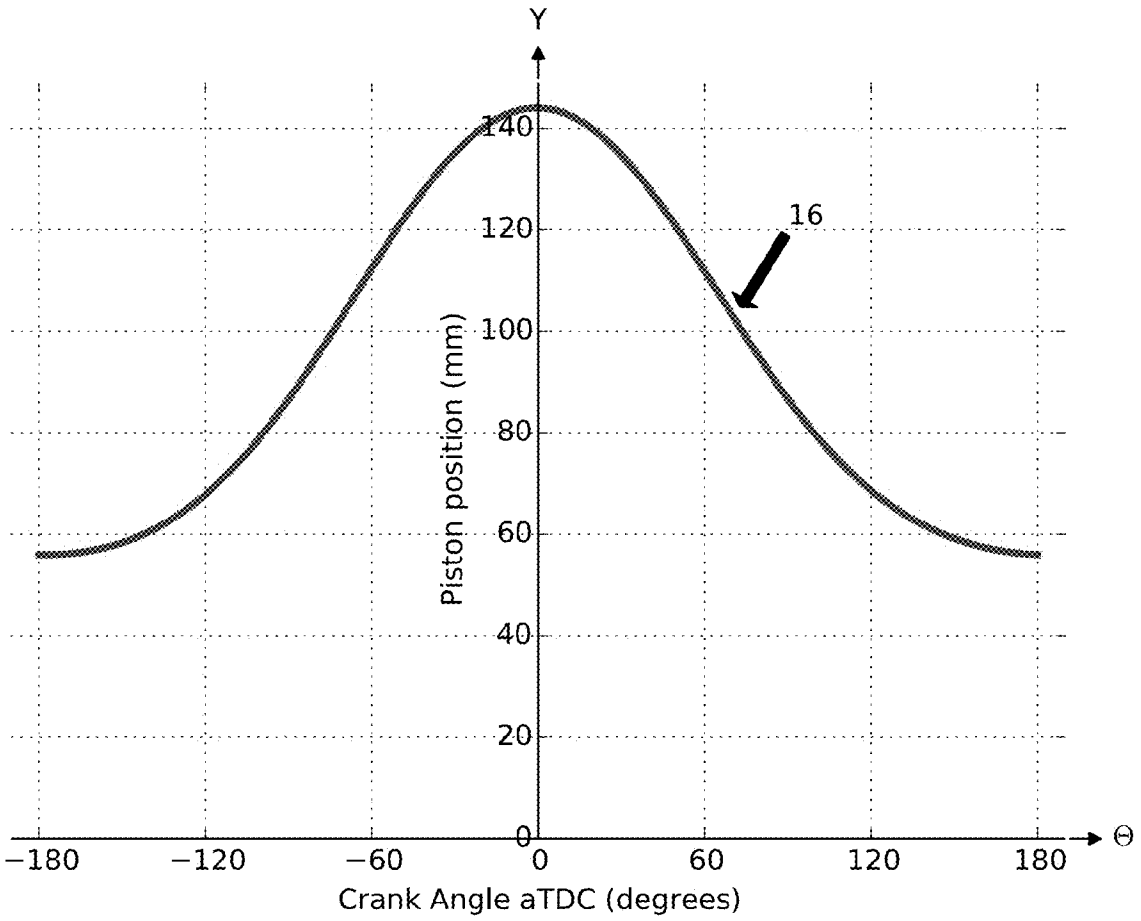
FIG. 7 is a curve depicting the piston movement position versus the crank angle for the same engine configuration as FIG. 6.

FIG. 4 schematically depicts an elliptical trajectory 13 traced by the pin 6 when the crank radius, r, is 50 mm, the distance between the pin 6 and the crank pin 7, $r_1$, is also 50 mm, and the position of the swinging block pivot 11 is fixed at $x_p$=110 mm and $y_p$=40 mm. The piston position curve 14 versus the crank angle is shown in FIG. 5, where the connecting rod 3 has a length of 100 mm and the offset of the cylinder center line from the crank shaft center line, $x_0$, is 50 mm (see FIG. 2). From FIG. 5, the stroke is 68 mm. When the swinging block pivot 11 moves to a location far away from the crank shaft at a position where $x_p$=400 mm and $y_p$=0 mm, the stroke of this engine increases to 88 mm and the compression ratio is the same as the previous configuration. Therefore, the engine displacement can be increased by around 30% when the swinging block position changes from its minimum $x_p$ value of 110 mm to its maximum $x_p$ value of 400 mm. FIG. 6 shows the trajectory curve 15 of the pin 6 for the latter maximum stroke configuration, and FIG. 7 shows its piston position curve 16 versus the crank angle.

With a 90 mm bore diameter, a single cylinder volume can be 0.474 L for the minimum stroke configuration and 0.610 L for the maximum stroke configuration. For a four-cylinder engine with these configurations, the engine displacement can be adjusted from 1.9 L to 2.44 L. Therefore, the current layout of the engine as an embodiment of the present invention ensures that a small displacement engine is used at low load conditions to achieve good thermal efficiency, and a large displacement engine is used at high load conditions to provide enough power.

Figure 8:
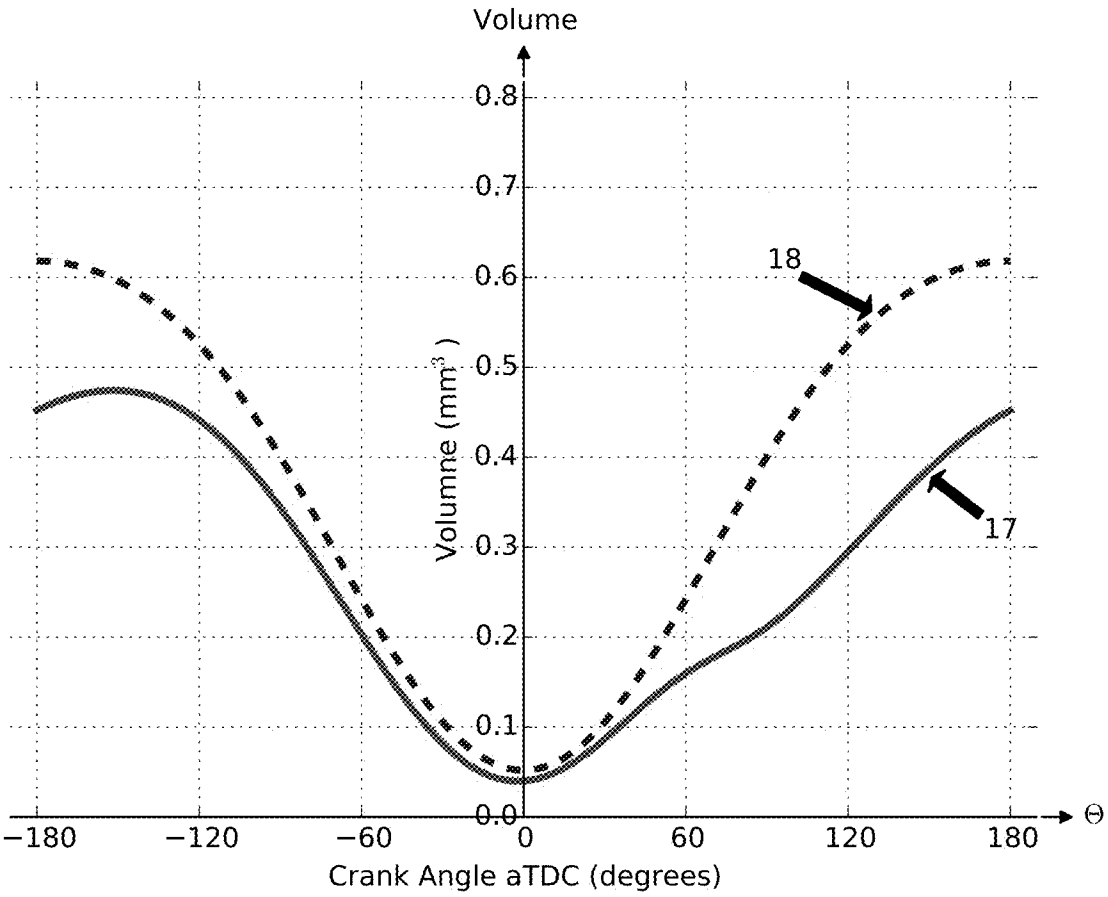
FIG. 8 is a comparison of piston position curves between the present engine invention with the minimum stroke configuration according to the embodiments of FIG. 1 and a conventional engine with a volume equaling the maximum stroke of the present engine invention.

FIG. 8 compares the cylinder volume between the current engine as an embodiment of the present invention with a minimum stroke configuration and a conventional engine with a volume equal to the same current engine but with a maximum stroke configuration. Curve 17 is the cylinder volume versus the crank angle of the current engine with a minimum stroke configuration, and curve 18 is of the conventional engine. Beyond a crank angle of approximately 60 degree measured after top dead center (aTDC), the cylinder volume of the current engine is obviously smaller than that of the conventional engine. This smaller volume of the current engine will lead to a relatively higher in-cylinder pressure, which at a relatively late crank angle aTDC (around 90 degrees) will result in a higher torque output. Therefore, the current engine as an embodiment of the present invention can provide higher torques than a conventional engine. This is another advantage of the present invention.

Figure 9:
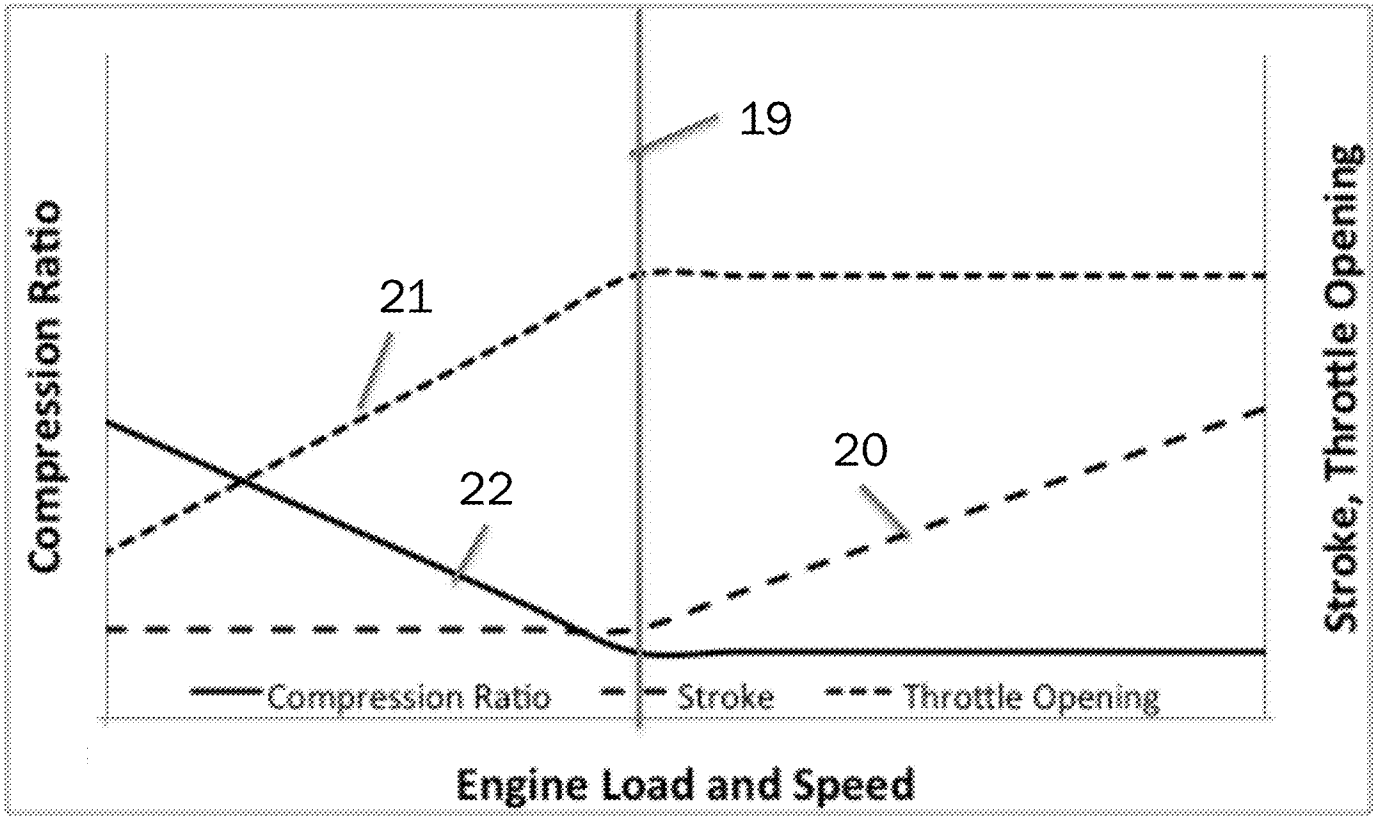
FIG. 9 illustrates an example of the controlling strategy of the present engine invention according to the embodiments of FIG. 1.

The controlling strategy of the variable stroke and compression ratio engine as an embodiment of the present invention is different from that of conventional gasoline engines. For conventional gasoline engines, the throttle position is adjusted to meet the engine speed and torque requirements. The disadvantage is that, when the throttle is partially closed, the engine pumping loss will increase, which results in a decrease in the engine thermal efficiency. For the present engine invention, the throttle can be kept at a wide opening position within a certain range of operating conditions (at a relatively high load and/or high speed condition). Instead of adjusting the throttle position, the engine stroke is adjusted by varying the position of the swinging block pivot 11 so that the engine displacement changes and, thus, the engine output power is changed to meet the engine load and/or speed requirements. Meanwhile, the position of the swinging block pivot 11 moves in such a way as to keep the compression ratio almost constant within this high load engine operating range. When the required engine load decreases, the stroke will be adjusted to decrease as well until it reaches its minimum value. If the required engine load continues to decrease, the throttle will start to close while the engine stroke stays at its minimum value. This partial closing of the throttle can result in a lower pressure and temperature of the gases in the intake manifold. Therefore, the knocking tendency of the engine will decrease and the engine will be able to run at a higher compression ratio condition to achieve a higher thermal efficiency. FIG. 9 illustrates an example of this controlling strategy. The vertical line 19 in the middle of this figure is the location of the minimum stroke. When the engine load is decreased from this position, the engine stroke curve 20 is constant at its minimum value, but the throttle-opening curve 21 starts to decrease and the compression ratio curve 22 starts to increase. When the engine load is decreased further, the throttle is also required to close more, and the compression ratio can be much higher. If the required engine loads are higher than that given by the minimum stroke (middle vertical line 19), the stroke (curve 20) must become longer in order to increase the engine displacement so that the engine can generate more power to meet the increased load requirement. During this process, the throttle is already at its widest opening position and it will stay in this position. In this high load/speed engine operating range, the compression ratio has to be controlled correctly to ensure that no engine knocking occurs.

It should be noted that the compression ratio would need to be adjusted when different fuels are applied. Higher compression ratio can be used, provided the condition of no engine knocks is satisfied, to achieve better engine thermal efficiency for higher octane number fuels.

One advantage of this layout of the current engine as an embodiment of the present invention is that the forces needed to move the swinging block are not required to be substantially high at high load conditions, because the position of the swinging block pivot 11 is far from the load point (pin 6) due to the resulting longer stroke. Therefore, the force applied to the swinging block does not necessarily increase. When a small stroke is required and the position of the swinging block pivot 11 is moved closer to the load point at pin 6, the force applied to the swinging block does not increase either because this will occur at a low load condition. In addition, the forces applied to the swinging block by the load vary in one engine cycle from negative to positive. If the force moving the swinging block pivot 11 keeps constant, it must be higher than the load force on the swinging block pivot 11 when the load force is within a small range about the zero value. Consequently, there should be no problem in moving the swinging block since the load force tends to be small at some moment of an engine cycle and the pushing force stays constant during the engine cycle. Therefore, this mechanism is designed such that a very large pushing force is not required to move the swinging block.

Figure 10:
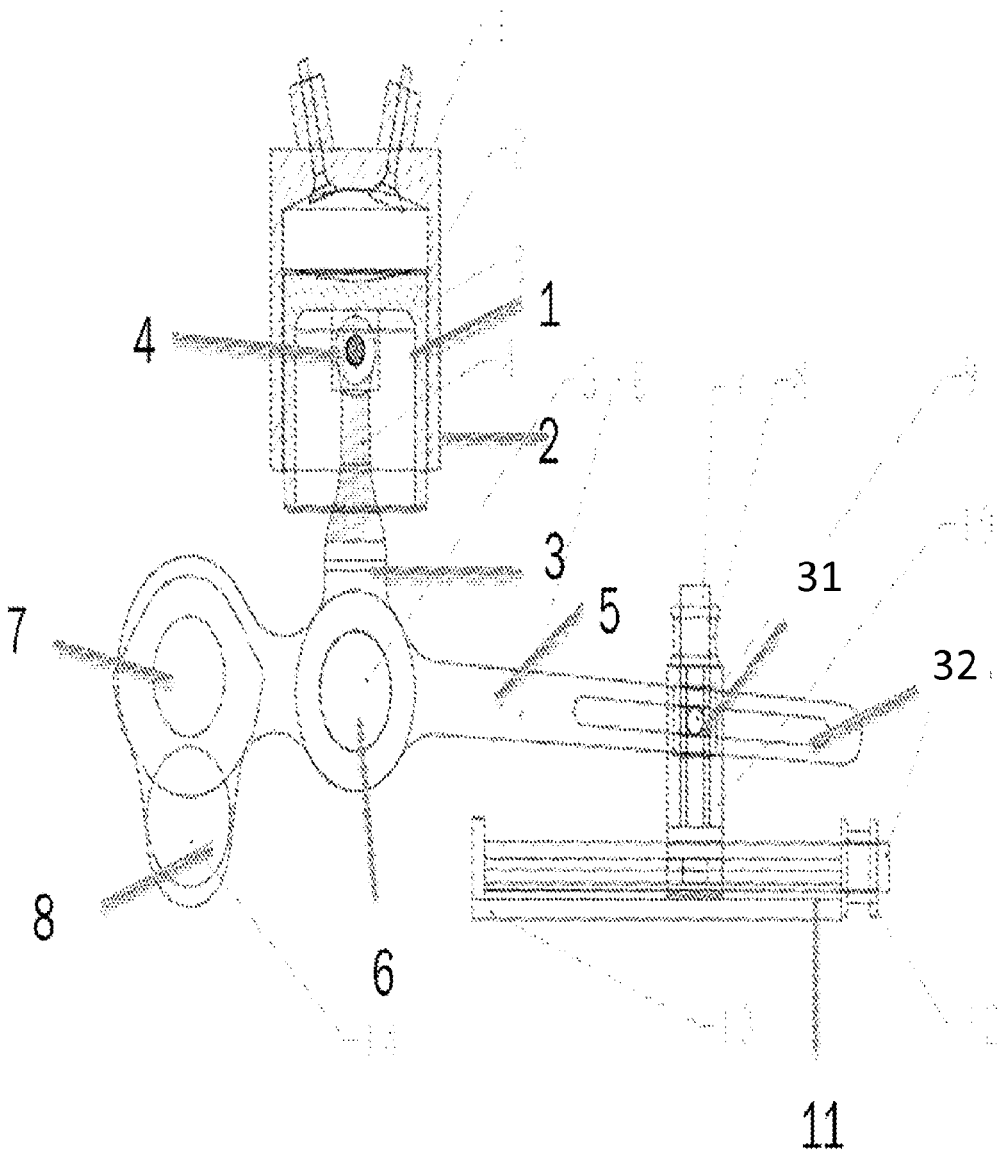
FIG. 10 is an example of a variation of the present engine invention, wherein a mechanism consisting of a sliding bearing pin and a groove in the horizontal connecting rod is used to replace the swinging block of the present engine invention according to the embodiment of FIG. 1.

It will be understood by those skilled in the field that the present invention is susceptible to a broad range of utilities and applications. Many embodiments, variations, modifications, and equivalent arrangements can and will be derived from the present invention. FIG. 10 shows an example of one particular variation of this invention, where a mechanism consisting of a sliding bearing pin 31 and a groove 32 are used to replace the swinging block 9 in FIG. 2. Both of the two engine layouts as embodiments of the present invention and as depicted in FIGS. 2 and 10 operate in the same exact way in principle. They may have some slight differences in terms of engine friction and/or reliabilities.

Figure 11:
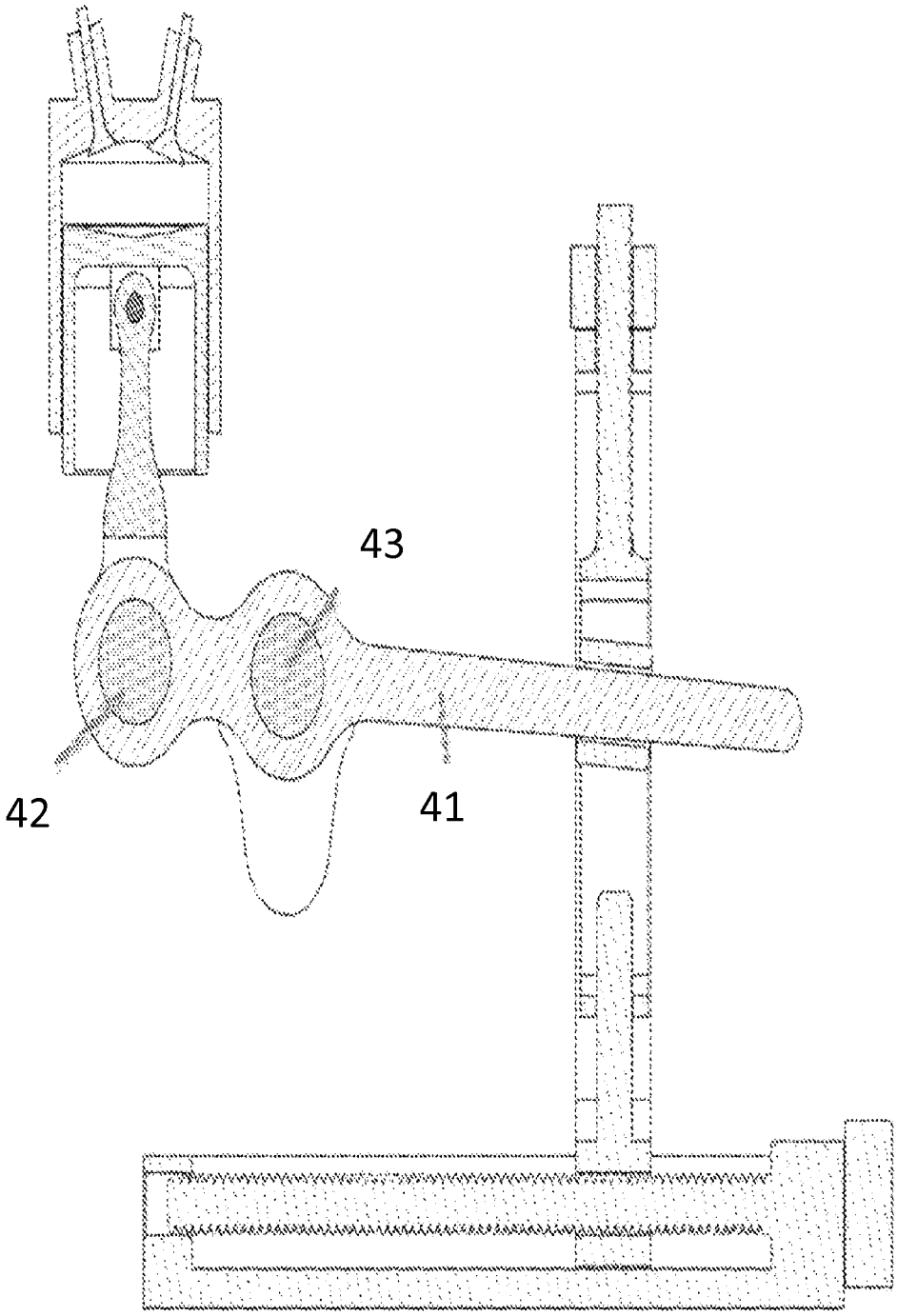
FIG. 11 is another variation of the present engine invention according to the embodiment of FIG. 1, wherein the vertical connecting rod has a pin joint with the horizontal connecting rod at one end of this horizontal connecting rod, and the crank pin joints with the horizontal connecting rod at its middle position.
Figure 12:
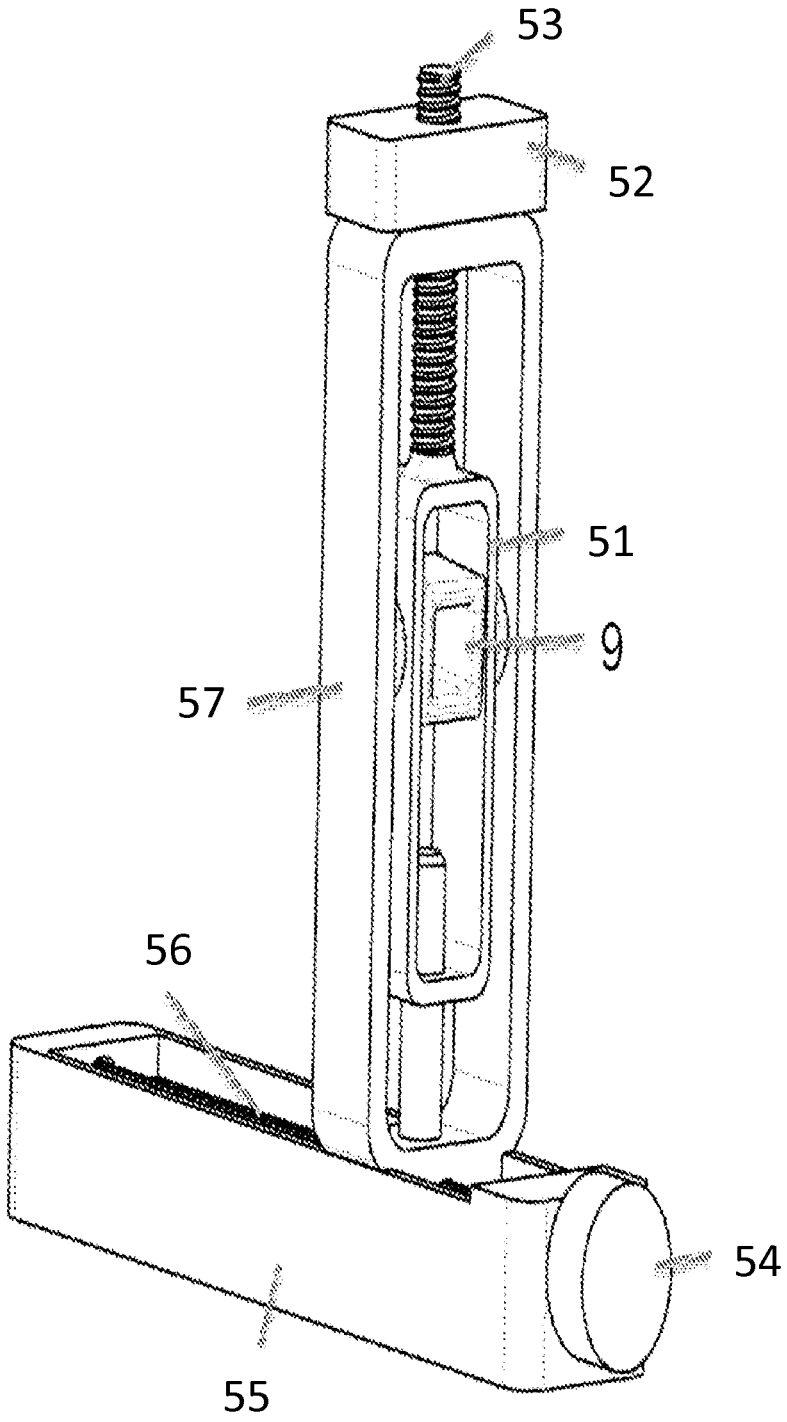
FIG. 12 is a translation stage that is used to move the pivot 11 in FIG. 3 in both X and Y directions.

Another example of a variation of the present invention is shown in FIG. 11 wherein one end of a horizontal connecting rod 41 is fastened to the vertical connecting rod with a pin 42, and a crank pin 43 is jointed to the horizontal connecting rod 41 at a point somewhere in the middle of the rod. This particular engine layout of the present invention may be able to reduce the engine size. However, the forces required to push the swinging block 9 moving will also increase. The device used to move the swing block 9 or the sliding pin 31 can be a machine that is similar to a horizontal and vertical translation stage mounted on the engine body. Its power can be either linear stepper motors or a hydraulic system. FIG. 12 shows a simplified view of a motorized translation stage as an example of such a device. It includes the swinging block 9 mounted onto a vertical moving part 51, a linear stepper motor 52 mounted onto the same vertical moving part and used to move a thread screw 53 vertically along with the vertical moving part 51, and another linear stepper motor 54 mounted onto a translation stage base 55 and used to rotate a thread screw 56, which in turn, moves a base 57 of the vertical moving part in a horizontal direction.

This variable stroke and compression ratio engine as an embodiment of the present invention can be either a single cylinder or a multiple cylinder engine. The mechanism disclosed above is used for one cylinder. That is, a multiple cylinder engine can use this same mechanism for each of its cylinders. The only exception may be a variation in the device used to move the swinging block 9. For a multiple cylinder engine, the swinging blocks may be controlled to move individually by using separate devices for each of the cylinders or be controlled to move together with all of the cylinders using only one device.

While the present invention has been described in detail with reference to specific embodiments of the invention, the invention is not limited to the above-described embodiments. Various modifications and variations of the embodiments described above may be suggested by people skilled in the field based on the essence of the present invention. The scope of the present invention is defined with reference to the following claims.

What is claimed is:

1. A variable stroke and compression ratio internal combustion engine, comprising:

an engine body;

a piston;

a crank that includes a crankshaft and a crankshaft pin;

a swinging block that is moveable relative to the engine body;

a first connecting rod that is connected to the crankshaft pin and is connected to the swinging block;

a second connecting rod that is connected to the first connecting rod and is connected to the piston; and a control device mounted on the engine body for moving the swinging block with respect to the engine body to adjust at least one of an engine stroke or a compression ratio, wherein the first connecting rod extends from a first end to a second end, the first connecting rod is connected to the crankshaft pin adjacent to the first end, the first connecting rod is connected to the swinging block adjacent to the second end, and the first connecting rod is connected to the second connecting rod at a location that is disposed between the first end and the second end.

2. The variable stroke and compression ratio internal combustion engine of claim 1, wherein the crankshaft that rotates on a crankshaft axis and the crankshaft pin moves in a circular path around the crankshaft axis in response to rotation of the crankshaft.

3. The variable stroke and compression ratio internal combustion engine of claim 2, wherein the second connecting rod is connected to the first connecting rod at a point that moves in a non-circular path in response to rotation of the crankshaft.

4. The variable stroke and compression ratio internal combustion engine of claim 3, wherein the circular path and the non-circular path are defined within a plane that extends perpendicular to the crankshaft axis.

5. The variable stroke and compression ratio internal combustion engine of claim 1, wherein the first connecting rod slides with respect to the swinging block in response to rotation of the crankshaft.

6. The variable stroke and compression ratio internal combustion engine of claim 1, wherein the control device includes a first translation stage for moving the swinging block in a first direction and a second translation stage for moving the swinging block in a second direction.

7. A variable stroke and compression ratio internal combustion engine, comprising:

a cylinder;

a piston that is disposed within the cylinder;

a crank that rotates on a crankshaft axis;

a guide member;

a control device that is connected to the guide member for moving the guide member;

a first connecting rod that extends perpendicular to the crankshaft axis, is connected to the crank at a first joint such that rotation of the crank moves the first joint in a circular path around the crankshaft axis, and is connected to the guide member at a second joint such that the first connecting rod slides with respect to the guide member at the second joint; and a second connecting rod that is connected to the first connecting rod at a third joint that is located on the second connecting rod between the first joint and the second joint such that rotation of the crank moves the third joint in a non-circular path and is connected to the piston at a fourth joint, wherein movement of the guide member by the control device is operable to modify the non-circular path.

8. The variable stroke and compression ratio internal combustion engine of claim 7, wherein the circular path and the non-circular path are defined within a plane that extends perpendicular to the crankshaft axis.

9. The variable stroke and compression ratio internal combustion engine of claim 7, wherein the control device includes a first translation stage for moving the guide member in a first direction, and a second translation stage for moving the guide member in a second direction, wherein the first direction is perpendicular to the second direction.

10. The variable stroke and compression ratio internal combustion engine of claim 7, wherein the guide member includes a bearing pin that is engaged with a groove formed on the first connecting rod.

11. The variable stroke and compression ratio internal combustion engine of claim 7, wherein the guide member includes a swinging block, and the first connecting rod extends through the guide member.

12. A variable stroke and compression ratio internal combustion engine, comprising:

an engine body;

a piston;

a crank that includes a crankshaft and a crankshaft pin;

a swinging block that is moveable relative to the engine body;

a first connecting rod that is connected to the crankshaft pin and is connected to the swinging block;

a second connecting rod that is connected to the first connecting rod and is connected to the piston; and a control device mounted on the engine body for moving the swinging block with respect to the engine body to adjust at least one of an engine stroke or a compression ratio, wherein the first connecting rod extends from a first end to a second end, the first connecting rod is connected to the second connecting rod adjacent to the first end, the first connecting rod is connected to the swinging block adjacent to the second end, and the first connecting rod is connected to the crankshaft pin at a location that is disposed between the first end and the second end.

13. A variable stroke and compression ratio internal combustion engine, comprising:

an engine body;

a piston;

a crank that includes a crankshaft and a crankshaft pin;

a swinging block that is moveable relative to the engine body;

a first connecting rod that is connected to the crankshaft pin and is connected to the swinging block;

a second connecting rod that is connected to the first connecting rod and is connected to the piston; and a control device mounted on the engine body for moving the swinging block with respect to the engine body to adjust at least one of an engine stroke or a compression ratio, wherein the control device includes a first translation stage for moving the swinging block in a first direction and a second translation stage for moving the swinging block in a second direction, the first translation stage includes a first stepper motor for causing movement of the swinging block in the first direction and the second translation stage includes a second stepper motor for causing movement of the swinging block in the second direction.

14. A variable stroke and compression ratio internal combustion engine, comprising:

a cylinder;

a piston that is disposed within the cylinder;

a crank that rotates on a crankshaft axis;

a guide member;

a control device that is connected to the guide member for moving the guide member;

a first connecting rod that extends perpendicular to the crankshaft axis, is connected to the crank at a first joint such that rotation of the crank moves the first joint in a circular path around the crankshaft axis, and is connected to the guide member at a second joint such that the first connecting rod slides with respect to the guide member at the second joint; and a second connecting rod that is connected to the first connecting rod at a third joint such that rotation of the crank moves the third joint in a non-circular path and is connected to the piston at a fourth joint, wherein the control device includes a first translation stage for moving the guide member in a first direction, and a second translation stage for moving the guide member in a second direction, wherein the first direction is perpendicular to the second direction, the first translation stage includes a first stepper motor for causing movement of the guide member in the first direction, and the second translation stage includes a second stepper motor for causing movement of the guide member in the second direction, and movement of the guide member by the control device is operable to modify the non-circular path.

* * * * *